US011713759B2

(12) United States Patent
Contaldi et al.

(10) Patent No.: US 11,713,759 B2
(45) Date of Patent: Aug. 1, 2023

(54) VANE COMPRESSOR WITH AN IMPROVED LUBRICATION SYSTEM

(71) Applicant: ING. ENEA MATTEI S.P.A., Vimodrone (IT)

(72) Inventors: Giulio Contaldi, Segrate (IT); Stefano Murgia, Vimodrone (IT)

(73) Assignee: ING. ENEA MATTEI S.P.A., Vimodrone (IT)

( * ) Notice: Subject to any disclaimer, the term of this patent is extended or adjusted under 35 U.S.C. 154(b) by 472 days.

(21) Appl. No.: 16/634,421

(22) PCT Filed: Jul. 27, 2018

(86) PCT No.: PCT/IB2018/055636
§ 371 (c)(1),
(2) Date: Jan. 27, 2020

(87) PCT Pub. No.: WO2019/021252
PCT Pub. Date: Jan. 31, 2019

(65) Prior Publication Data

US 2020/0158107 A1 May 21, 2020

(30) Foreign Application Priority Data

Jul. 27, 2017 (IT) ..... 102017000086572

(51) Int. Cl.
*F04C 18/344* (2006.01)
*F04C 29/00* (2006.01)
*F04C 29/02* (2006.01)

(52) U.S. Cl.
CPC ..... *F04C 18/3446* (2013.01); *F04C 29/0007* (2013.01); *F04C 29/02* (2013.01)

(58) Field of Classification Search
CPC ... F04C 18/3446; F04C 29/0007; F04C 29/02
See application file for complete search history.

(56) References Cited

U.S. PATENT DOCUMENTS 2,961,151 A * 11/1960 Fobian ..... F04C 29/02 418/13
3,820,923 A * 6/1974 Zweifel ..... F04C 29/0007 418/87

(Continued)

FOREIGN PATENT DOCUMENTS

CN 106050673 10/2016
DE 102018107494 A1 * 10/2019 ..... F01D 25/20

(Continued)

OTHER PUBLICATIONS

Office Action and Search Report issued in the counterpart Chinese Application No. 201880062702.9 dated Jul. 9, 2021, including English translation (15 pages).

*Primary Examiner* — Mary Davis
(74) *Attorney, Agent, or Firm* — McCracken & Gillen LLC

(57) ABSTRACT

Vane compressor comprising a stator, a rotor housed in the stator and provided with a body internally tangent to a side wall of the stator and with a plurality of vanes sliding in respective seats formed in the body of the rotor and pushed in a centrifugal direction to sealingly cooperate with the side wall of the stator, and a lubrication system comprising in combination one or more solid jet nozzles, arranged in the side wall of the stator to direct the solid jet towards the rotor, and at least one axial spray nozzle.

12 Claims, 5 Drawing Sheets

(56) References Cited

U.S. PATENT DOCUMENTS

| | | | | |
|---|---|---|---|---|
| 3,820,924 | A | 6/1974 | Cassidy | |
| 4,071,306 | A | 1/1978 | Calabretta | |
| 4,773,836 | A | 9/1988 | Moore | |
| 4,861,246 | A | 8/1989 | Zimmern | |
| 2010/0183467 | A1 | 7/2010 | Sundheim | |
| 2013/0001325 | A1* | 1/2013 | Schneider | B05B 1/3447 239/487 |

FOREIGN PATENT DOCUMENTS

| | | |
|---|---|---|
| EP | 0 525 924 | 2/1993 |
| GB | 1318884 | 5/1973 |
| JP | S61164095 | 7/1986 |
| JP | 2001140781 | 5/2001 |

* cited by examiner

VANE COMPRESSOR WITH AN IMPROVED LUBRICATION SYSTEM

CROSS-REFERENCE TO RELATED PATENT APPLICATIONS

This application is a U.S. National Phase Application under 35 U.S.C. § 371 of International Patent Application No. PCT/IB2018/055636, filed on Jul. 27, 2018, which claims priority from Italian Patent Application No. 102017000086572 filed on Jul. 27, 2017, all of which are incorporated by reference, as if expressly set forth in their respective entireties herein.

TECHNICAL FIELD

The present invention relates to a vane compressor.

BACKGROUND ART

Known vane compressors comprise a stator provided with an intake port and with a delivery port, a rotor eccentrically housed in the stator, internally tangent to a side wall of the stator and provided with a plurality of vanes, sliding in a radial direction with respect to the rotor and sealingly cooperating with the stator, and a lubrication system comprising a plurality of mutually aligned solid jet nozzles arranged in a side wall of the stator to direct the solid jet towards the rotor.

The oil jet supplied by the nozzles has the triple purpose of:

- lubricating the relative sliding zone between the vanes and the rotor body, between the vane head and the stator barrel and between the ends of the vanes and the tops of the covers;
- helping creating a seal between the vanes and the stator and between the vanes and the covers; and
- cooling the compressor to obtain a compression that approximates adiabatic compression as much as possible.

It has been calculated that in the known compressors of the type described, only 10% of the used oil flow would be sufficient to carry out the first two functions. This means that about 90% of the oil flow is actually used to cool the compressor.

This means a significant amount of wasted work to pump oil. It has been proposed to use axial spray nozzles instead of radial orifices in order to optimize the heat exchange between air and oil and therefore reduce the amount of oil necessary for cooling the compressor. Experimental studies have shown that this solution allows energy savings if compared to the conventional solution with solid jet nozzles.

DISCLOSURE OF INVENTION

An object of the present invention is to provide a vane compressor with an improved lubrication system, which allows reducing the amount of used oil and, consequently, the energy losses associated with it.

This object is achieved by a vane compressor according to claim 1.

The use, in combination, of one or more axial spray nozzles and of one or more solid jet nozzles allows optimizing each type of nozzle according to its main function, and obtaining an optimal cooling and lubrication with a much smaller amount of oil if compared to conventional solutions.

Preferably, the axial spray nozzle is arranged upstream of the solid jet nozzle, in a position corresponding to the beginning of the compression phase, and is a swirl nozzle to ensure a fine spraying of the oil.

If allowed by the size of the compressor, a plurality of axial spray nozzles arranged in succession in a circumferential direction can be used.

According to a preferred embodiment of the invention, the vanes are tilted with respect to a radial direction in the direction of the rotor motion by an angle comprised between 10° and 20°, and preferably approximately equal to 15°. This allows reducing friction and stress, and therefore the power absorbed by the compressor.

Preferably, also the solid jet nozzle or nozzles are tilted with respect to a radial direction in the direction of the rotor motion by an angle of 10-40°, and preferably about 25°. In this way, the solid jet exerts on the vanes a force having a component in a tangential direction thus producing useful work for rotationally driving the rotor.

According to a further preferred embodiment of the invention, the compressor comprises at least two solid jet nozzles, mutually aligned in axial direction and supplied by a shared axial manifold.

BRIEF DESCRIPTION OF THE DRAWINGS

For a better understanding of the present invention, a preferred embodiment is described below, by way of non-limiting example and with reference to the attached drawings, in which.

BEST MODE FOR CARRYING OUT THE INVENTION

Figure 1:
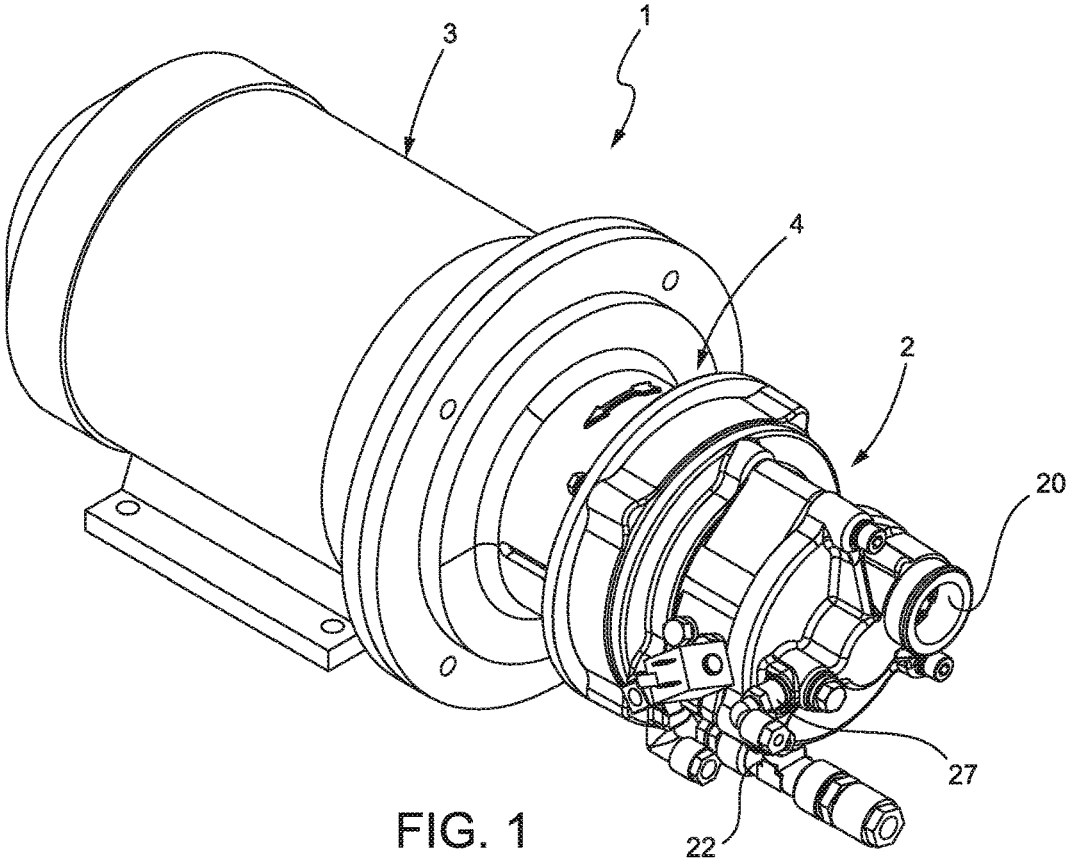
FIG. 1 is a perspective view of a compressor unit comprising a vane compressor according to the invention.
Figure 2:
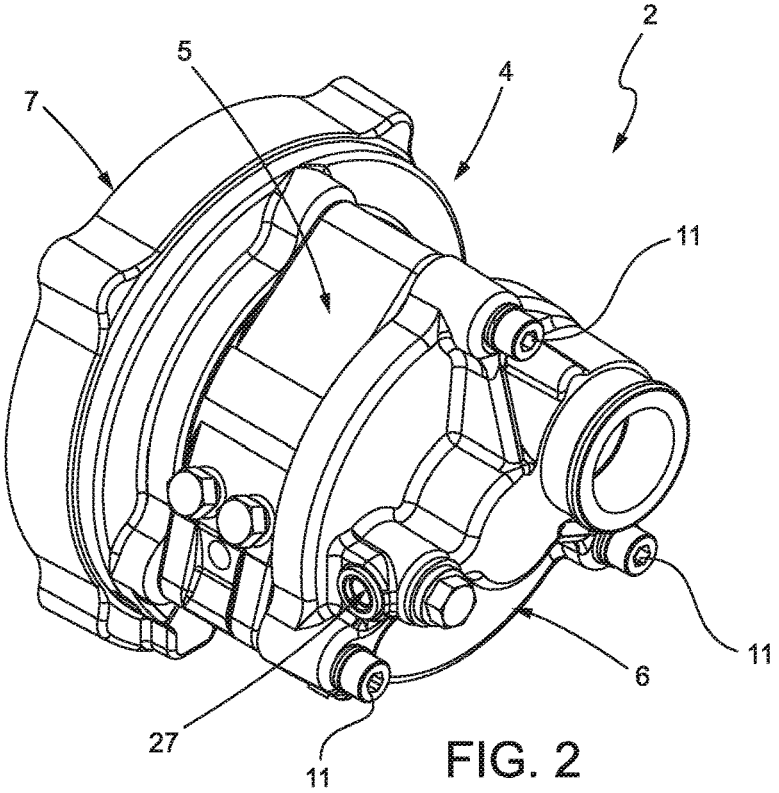
FIG. 2 is a perspective view of the compressor of FIG. 1.
Figure 3:
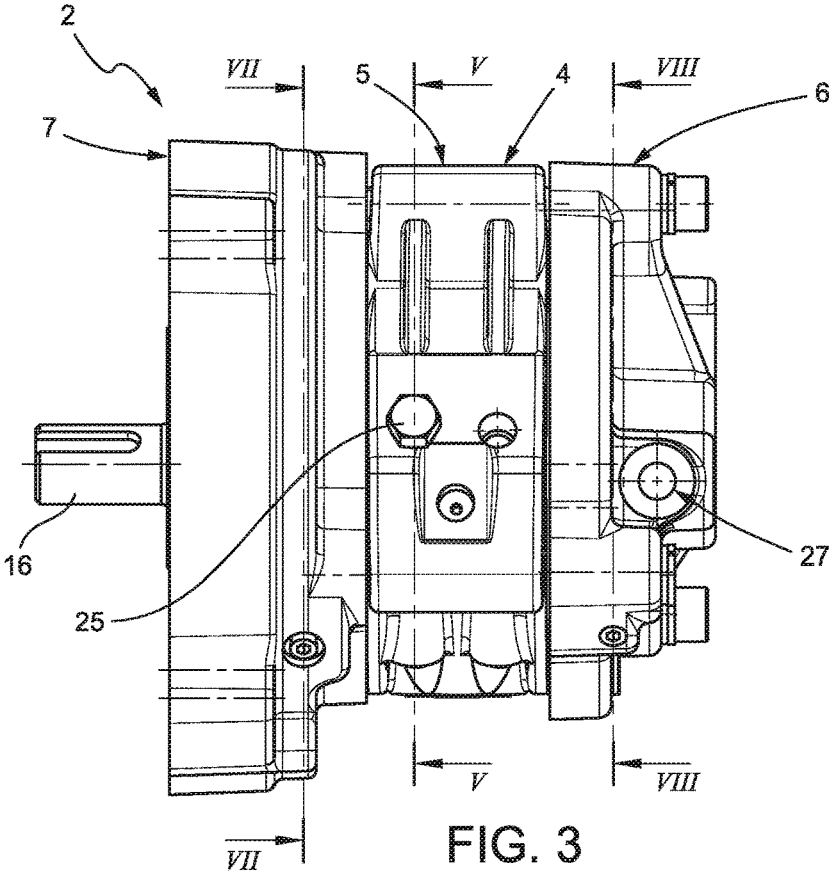
FIGS. 3 and 4 are respectively side and rear views of the compressor.
Figure 4:
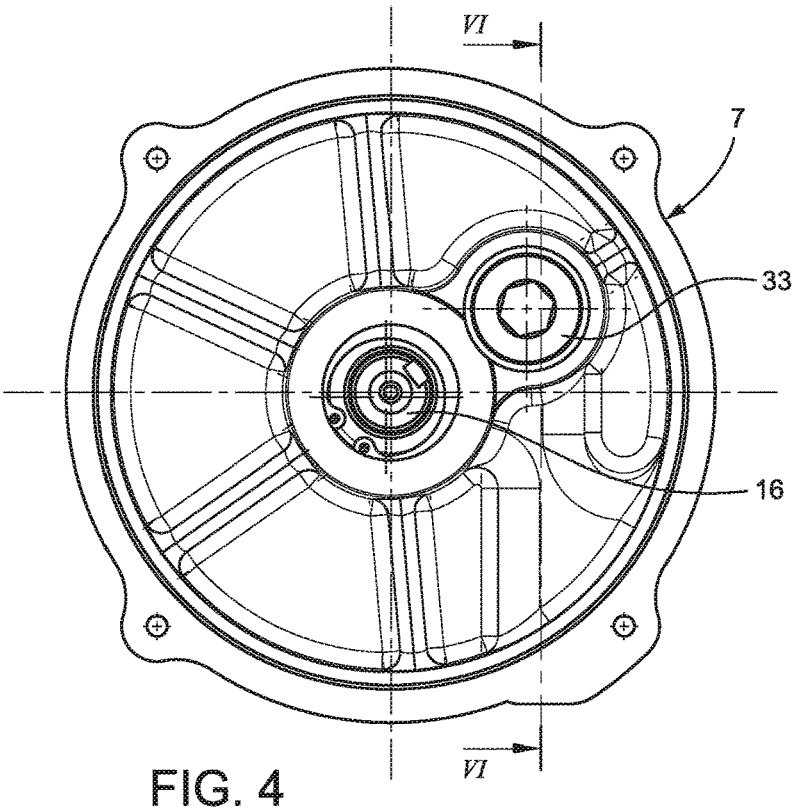

With reference to FIG. 1, a compressor unit generally indicated with 1 comprises a vane compressor 2 and an electric motor 3. The shown compressor unit is preferably used as an on-board compressor of a motor vehicle, for example a truck, but the present invention is not limited to this application and can be applied to compressors of any power and size, for vehicular or industrial applications.

The electric motor 3, shown as a simple reference, is not further described since it is not part of the present invention.

The compressor 2, shown in FIGS. 2 to 9, is provided with an outer casing 4 formed by an intermediate portion defining a stator 5 of the compressor 2, a front cover 6 and a rear flange 7 for connection to the electric motor 3. The front cover 6 and the flange 7 are secured on axially opposite parts with respect to the stator 5 by means of a plurality of screws 11.

The stator 5 is provided with a side wall 8, which internally defines a cylindrical cavity 9 (FIG. 5) having an axis A.

The compressor 2 further comprises a rotor 10, having a substantially cylindrical shape, which has an axis B that is parallel but distinct from axis A. The rotor 10 is housed inside the cylindrical cavity 9 of the stator 5 and is rotatable about the axis B.

The rotor 10 comprises a substantially cylindrical body 12, whose outer side surface 12*a* is tangent to an inner side surface 9*a* of the cylindrical cavity 9 of the stator 5 along a generatrix G.

The rotor 10 and the stator 5 define between them an annular chamber 18 having a radially variable amplitude.

The rotor 10 is further provided with a plurality of vanes 13 equally spaced in a circumferential direction, tilted with respect to a radial direction in the rotation direction of the rotor (indicated by an arrow in FIG. 5) by an angle comprised between 10° and 20°, and preferably equal to 15°.

The vanes 13 are slidingly housed in respective seats 14 consisting of slots formed in the body 12 of the rotor 10 and open on the side surface 12*a* of the body.

The vanes 13 are pushed towards the outside by centrifugal force and pressure, thus sealingly sliding substantially in contact (unless it is provided a lubricant oil gap, as described hereinafter) with the inner surface 9*a* of the stator 5. For this purpose, the vanes 13 are preferably provided with a rounded outer edge 15.

A shaft 16 (FIGS. 3 and 4) having an axis B is rigidly coupled to the rotor 10, said shaft axially protruding from the flange 7 through a central hole of the same and being adapted to be coupled to an output shaft of the electric motor 3 in a known and not shown way.

The vanes 13 divide the chamber 18 into a plurality of spaces 17 having a variable volume.

The compressor 2 comprises an axial intake duct 20, formed in the front cover 6 (FIG. 1), which communicates with an intake port 21 defined by an inner recess of the wall 8 of the stator 5 extending for an angular width equal to at least two compartments 17 and arranged downstream of the tangent zone between the rotor 8 and the stator 5 in the direction of the rotor motion.

Analogously, the compressor 2 comprises an axial delivery duct 22, obtained in a lower area of the front cover 6 (FIG. 1), which communicates with a delivery port 23 defined by an inner recess of the wall 8 of the stator 5 extending for an angular width approximately corresponding to the angular width of a space 17 and arranged upstream of the tangent zone between rotor 8 and stator 5 in the direction of the rotor motion, in the lower area of the chamber 18.

The compressor 2 comprises a lubrication system 24 configured to bring lubricating oil into the chamber 18 and to the relative sliding surfaces of the compressor.

According to the present invention, the lubrication system (FIGS. 6-9) comprises a plurality of solid jet nozzles 25, having a transverse axis with respect to the axis of the compressor 2, and at least an axial spray nozzle 26.

The solid jet nozzles 25 are housed in the wall 8 of the stator 5, thus injecting the jet into the chamber 18 with a tilted direction with respect to the radial direction, in the direction of the rotor motion. In particular, the axis of the solid jet nozzles 25 is inclined with respect to the radial direction by an angle comprised between 15° and 40° and preferably 25°.

In the embodiment shown by way of example, the nozzles 25 are two and are mutually aligned in an axial direction. The solid jet nozzles 25 are arranged in a circumferential direction with respect to the chamber 18 at about 90° from the end of the intake port in the motion direction, and have an axis inclined by 25° with respect to the radial direction.

The spray nozzle 26 is housed in the flange 7, in a radial position exiting into the chamber 18.

The spray nozzle 26 is arranged upstream of the solid jet nozzles 25 with respect to the rotation direction of the rotor 14, and is preferably a swirl nozzle.

In these nozzles, the oil moving with a rotary motion inside a swirl chamber is subjected to high centrifugal forces, which favour its atomization. The tangential component imparted to the flow allows obtaining sprays with wide opening angles. In the swirl spray nozzles, the rotary motion of the fluid is imparted thanks to the special tangential inserts or conduits, which guarantee a very fine atomization and a rather even distribution of the drops on the spray section.

The position of the spray nozzle 26 in an angular direction along the chamber 18 is such as to inject the atomized jet into the spaces 17 in an initial compression phase, i.e. immediately after the spaces 17 have been isolated from the intake port 21. In geometrical terms, this means that the spray nozzle 26 must be at an angular distance from the end of the intake port 21 corresponding to at least the sum of the angular width of a compartment 17 and of the angle formed between a vane 13 and the surface 9*a*.

To supply the nozzles 25 and 26, the lubrication system 24 essentially comprises a supply fitting 27 arranged on the cover 6 and configured to be coupled to a source of pressurized oil.

The lubrication system 24 comprises a plurality of oil conduits, made in a known manner as bores closed by respective plugs, which are shown in FIGS. 5-9 with a grey pattern.

Figure 6:
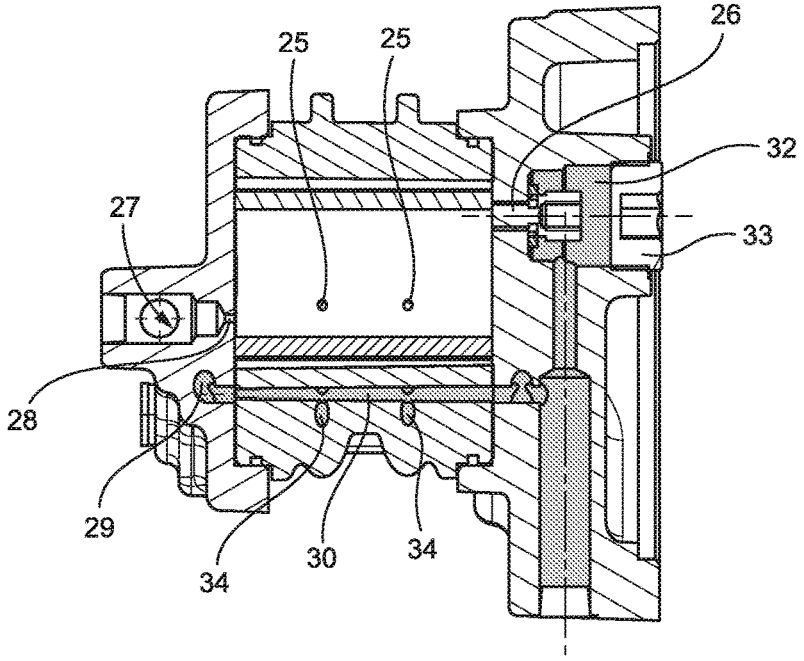
FIG. 6 is a section along the line VI-VI of FIG. 4.

In particular, the fitting 27 is coupled to a lubrication hole 28 of the axial contact zone between the rotor 10 and the cover (FIG. 6). Through channels 29 arranged inside the cover 6 and only partially visible in FIG. 6, the fitting 27 is coupled to an axial manifold 30, which axially crosses the stator 5 and ends in the flange 7, in turn provided with inner channels 31 connecting it to a cavity 32 closed by a plug 33, in which the spray nozzle 26 is immersed.

Two conduits 34 (FIGS. 5, 6 and 9) also branch off from the axial manifold 30 to supply oil to the nozzles 25.

Figure 7:
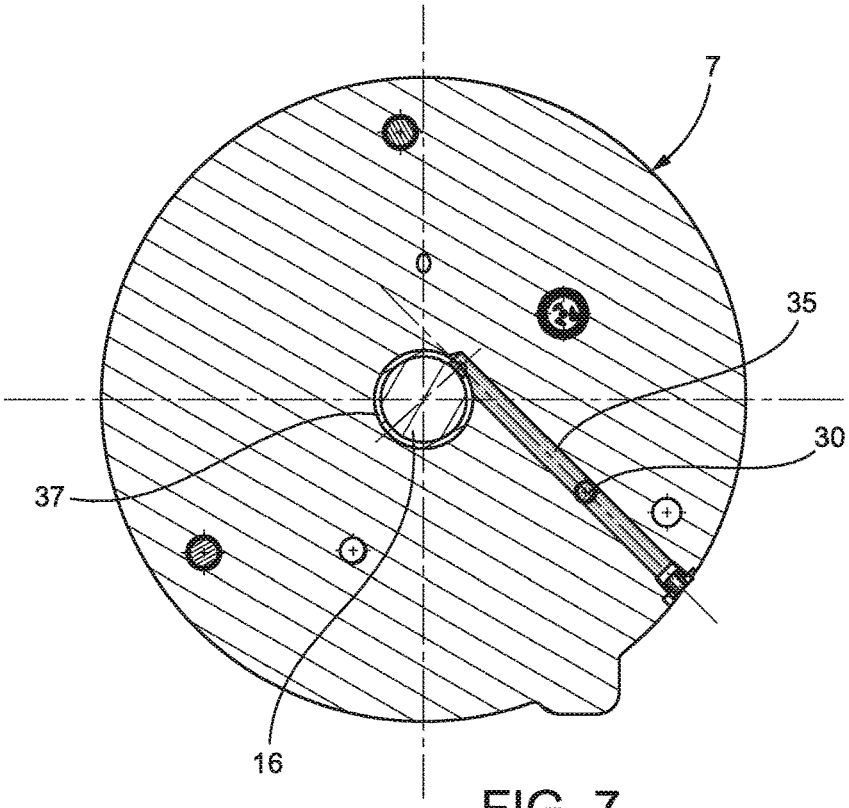
FIGS. 7 and 8 are sections along the lines VII-VII and, respectively, VIII-VIII of FIG. 3.
Figure 8:
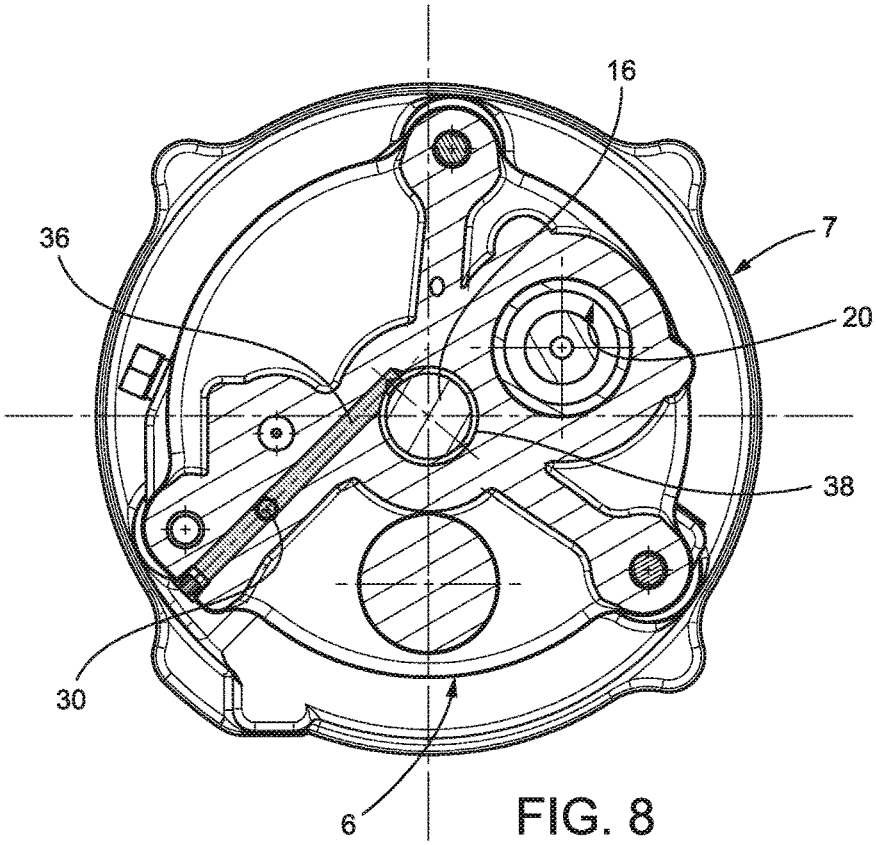
Figure 9:
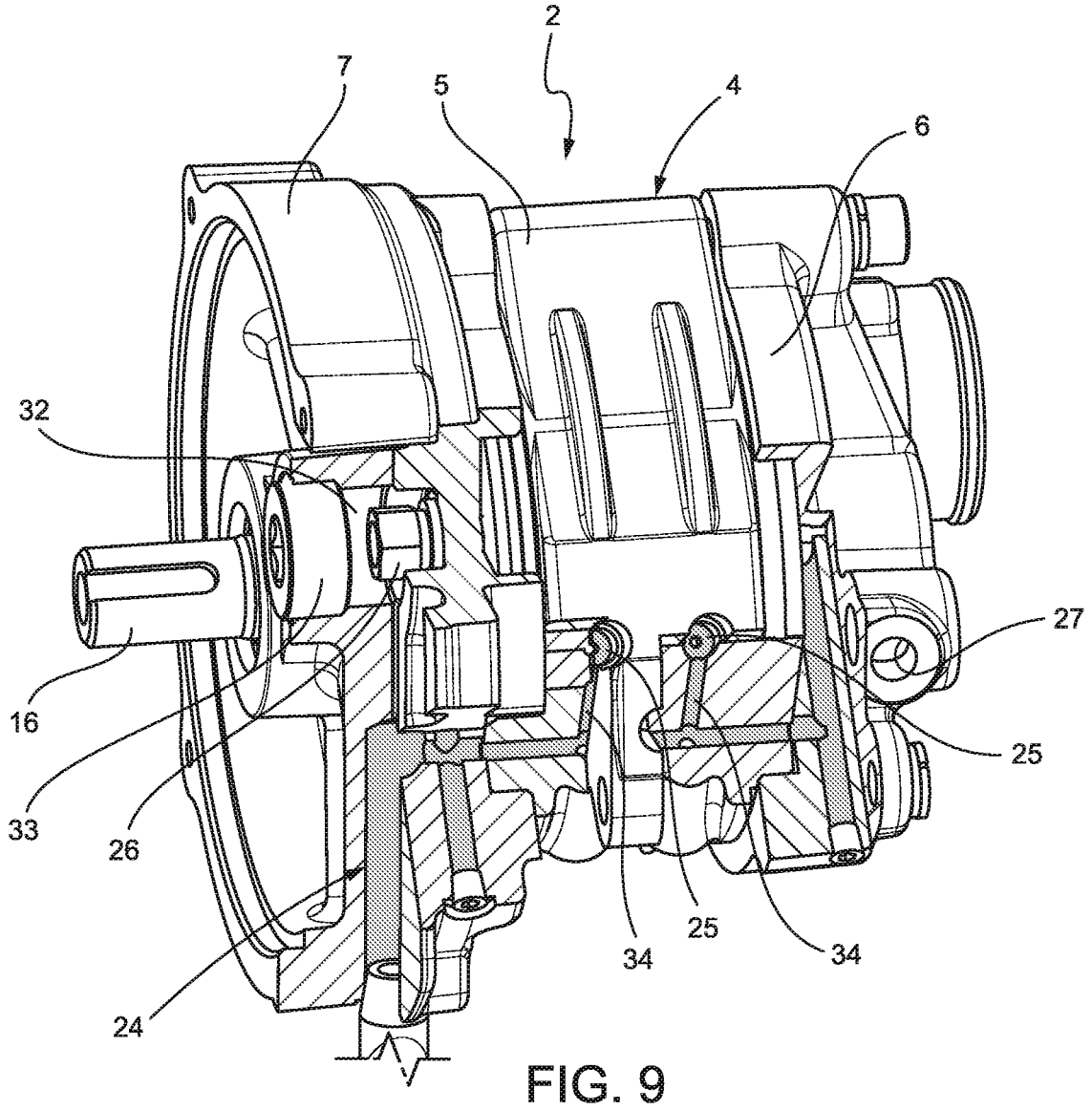
FIG. 9 is a perspective view of the compressor, with parts removed for clarity's sake.

FIGS. 7 and 8 show channels 35, 36, respectively formed in the flange 7 and in the cover 6, for supplying lubricating oil from the axial manifold 30 to respective sliding bearings 37, 38, which support the shaft 16.

The operation of the compressor 1 is as follows.

Figure 5:
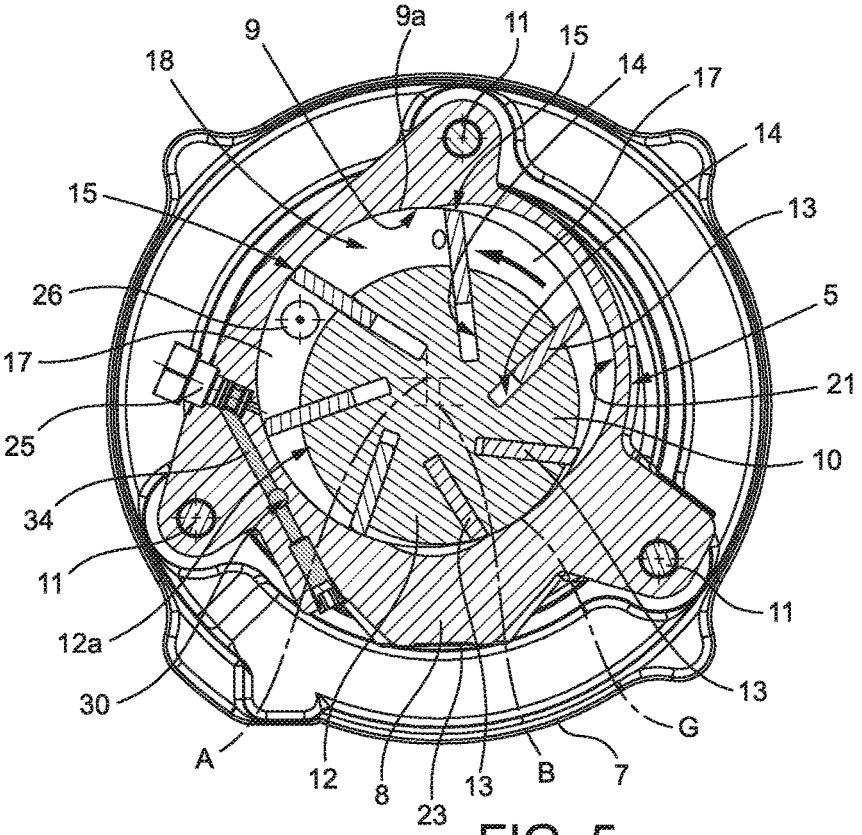
FIG. 5 is a section along the line V-V of FIG. 3.

The rotor 10 is driven by the electric motor 3 (anticlockwise with reference to FIG. 5). Starting from the tangency generatrix G between the rotor 10 and the stator 5, the compartments 17 increase in volume and draw air from the intake port 21; once passed the intake port, the compartments 17 are insulated and, starting from an angular position opposite to the one of the tangency generatrix, their volume progressively decreases, thus effecting the compression. The compressed air is discharged through the delivery port 23.

At the beginning of the compression, the jet of the nozzle axially crosses each compartment 17. This jet has a predominant cooling function, which is carried out in a particularly effective manner because the fine atomization of the jet favours the heat exchange between the air and the oil. The mass flow of the lubricant jet depends on the compressor size, the number of nozzles and the injection pressure, and is generally in the order of 5-10 times the air flow rate processed by the compressor. The flow rate and the size of the (conical) jet are also selected according to the size of the compartment in order to prevent, or delay as much as possible, the jet from contacting the metal walls of the compartment and the consequent coalescence of the oil that decreases the exchange surface. Generally, these conditions are met with a jet crossing speed of the order of 20 m/s.

The solid jets generated by the nozzles 25 have the main purpose of lubricating the relative sliding zone between the vanes 13 and the respective seats 14, in particular close to the interlocking area of the vanes where the stresses are concentrated.

The tilted position of the nozzles 25, in combination with the tilted position of the vanes 13, is such that the solid oil jets invest the vanes 13 with a tangential force component, which produces useful work for rotationally driving the rotor 10.

The use of the described "hybrid" lubrication (axial spray nozzle in combination with solid jet nozzles) achieves a 50% oil flow savings. This allows using less oil or, for the same volume of used oil, doubling the maintenance intervals.

By reducing the energy spent to pump the oil and thanks to the tilted position of the vanes 13, savings of 7% on the absorbed power have been obtained.

Finally, it is clear that the described compressor may undergo modifications and variations that are within the scope of protection defined by the claims.

In particular, depending on the size of the compressor, it is possible to vary the number of nozzles. In the case of larger axial dimensions, it is possible to use more than two solid jet nozzles, and in the case of more powerful industrial compressors, it is possible to use a series of spray nozzles arranged in succession in a circumferential direction.

The invention claimed is:

1. Vane compressor comprising:

a stator (5) having an axis (A) and provided with at least one intake port (21) and at least one delivery port (23), a rotor (10) housed in the stator (5) and having an axis (B) parallel to the axis (A) of the stator (5), the rotor (10) being provided with a body (10) internally tangent to a side wall (8) of the stator (5) and with a plurality of vanes (13) sliding in respective seats (14) formed in the body (12) of the rotor (10) and pushed in a centrifugal direction so as to sealingly cooperate with the side wall (8) of the stator (5), the vanes (13) delimiting in pairs with one another a plurality of compartments (17) having different volumes;

a lubrication system (24) comprising at least one solid jet nozzle (25) arranged in the side wall (8) of the stator (5) to direct the solid jet towards the rotor (10), characterised by comprising at least one axial spray nozzle (26) in combination with said at least one solid jet nozzle (25), said at least one axial spray nozzle (26) being configured to inject a spray jet into the compartments (17) in an axial direction with respect to the stator (5) and to the rotor (10).

2. The compressor as claimed in claim 1, characterised in that said at least one axial spray nozzle (26) is arranged upstream of the at least one solid jet nozzle (25) with reference to the rotation direction of the rotor (10).

3. The compressor as claimed in claim 1, characterised in that said at least one axial spray nozzle (26) is arranged at an angular distance from the intake port (21) at least corresponding to the sum of the angular width of one of said compartments (17) and of the angle subtended by a vane (13).

4. The compressor as claimed in claim 1, characterised in that the at least one spray nozzle (26) is a swirl nozzle.

5. The compressor as claimed in claim 1, characterised in that the at least one axial spray nozzle comprises a plurality of axial spray nozzles arranged in succession in a circumferential direction.

6. The compressor as claimed in claim 1, characterised in that the plurality of vanes (13) are tilted with respect to a radial direction in the motion direction of the rotor (10).

7. The compressor as claimed in claim 1, characterised in that the tilting of the plurality of vanes (13) with respect to a radial direction ranges between 10° and 20°.

8. The compressor as claimed in claim 7, characterised in that the tilting of the plurality of vanes (13) with respect to a radial direction is equal to 15°.

9. The compressor as claimed in claim 1, characterised in that at least said one solid jet nozzle (25) has an axis inclined with respect to a radial direction in the motion direction of the rotor (10).

10. The compressor as claimed claim 1, characterised in that the inclination of the axis of the at least one solid jet nozzle (25) with respect to a radial direction ranges between 15° and 40°.

11. The compressor as claimed in claim 10, characterised in that the inclination of the axis of the at least one solid jet nozzle (25) with respect to a radial direction is equal to 25°.

12. The compressor as claimed claim 1, characterised in that the at least one solid jet nozzle (25) comprises at least two mutually aligned solid jet nozzles (25), arranged in an axial direction and supplied through a shared axial manifold (30).

* * * * *